US006718648B1

(12) United States Patent
Knight

(10) Patent No.: US 6,718,648 B1
(45) Date of Patent: Apr. 13, 2004

(54) METHOD AND APPARATUS FOR MEASURING A LENGTH OF A PRESSED PILE

(76) Inventor: Tony S. Knight, P.O. Box 2586, Humble, TX (US) 77347

( * ) Notice: Subject to any disclaimer, the term of this patent is extended or adjusted under 35 U.S.C. 154(b) by 0 days.

(21) Appl. No.: 10/044,028

(22) Filed: Jan. 11, 2002

(51) Int. Cl.[7] ..... G01B 3/10

(52) U.S. Cl. ..... 33/755; 33/701; 33/758; 33/759; 33/1 H

(58) Field of Search ..... 33/755, 756, 758, 33/759, 760, 701, 483, 493, 1 H, 624; 405/231, 232

(56) References Cited

U.S. PATENT DOCUMENTS 3,965,579 A * 6/1976 Woods ..... 33/758
5,288,175 A * 2/1994 Knight ..... 405/232
5,399,055 A * 3/1995 Dutton, Jr. ..... 405/230
5,448,914 A * 9/1995 Van Middeldorp ..... 33/713
5,452,523 A * 9/1995 Jansen ..... 33/755
5,753,818 A * 5/1998 Mercado ..... 73/594
5,996,414 A * 12/1999 Mercado ..... 73/594
6,179,526 B1 * 1/2001 Knight et al. ..... 405/232
6,200,070 B1 * 3/2001 Knight ..... 405/232

* cited by examiner

*Primary Examiner*—Diego Gutierrez
*Assistant Examiner*—Madeline Gonzalez
(74) *Attorney, Agent, or Firm*—Harrison & Egbert

(57) ABSTRACT

A method of measuring a length of a pile which supports a structure upon the earth including affixing a flexible strand to a first pile segment, driving the first pile segment a desired distance into the earth such that the flexible strand extends along the length of the first pile segment along an exterior surface thereof, and driving a plurality of additional pile segments into the earth such that the pile segments reside upon an end of the first pile segment. The flexible strand extends along a length of the plurality of additional pile segments on the exterior surface thereon. The flexible strand has indicia thereon indicative of length measurements. The flexible strand is formed of an inelastic material.

10 Claims, 2 Drawing Sheets

METHOD AND APPARATUS FOR MEASURING A LENGTH OF A PRESSED PILE

BACKGROUND OF THE INVENTION

1. Field of the Invention

The present invention relates to the installation of pressed pile segments into the earth. More particularly, the present invention relates to methods and apparatus for the measurement of the depth or depth of penetration of the pressed pile during and after it is installed into the earth. The present invention also relates to pile measurement devices and methods.

2. Description of Related Art

There is a type of precast concrete pile used in the underpinning of building foundations comprised of vertically stacked, unconnected, precast concrete segments. These segments are pressed or driven vertically into the soil one at a time until adequate load capacity is obtained. This type of pile is distinctive in that it can be installed with almost no clearance, usually beneath an existing structure.

Although sensible, this pile has several significant disadvantages: (1) the pile segments may not be aligned, other than being stacked on each other, and detrimental misalignment can occur; and (2) independent inspection of the installed pile depth is only possible by providing full-time inspection personnel during installation to monitor the quantity of pile segments used in each pile location. Lack of proper independent inspection of pile depth can lead to inadequate pile penetration, which in highly expansive soil produces an unstable installation subject to continual movements caused by seasonal changes in soil moisture.

During installation, it is often difficult for the installers to fully ascertain whether the pile segments are becoming misaligned. Typically, the workmen during the installation procedure will simply drive one pile segment upon the other with little or no regard to the amount of misalignment that may occur. Often, the number of pile segments that are installed is subject to some disagreement. In certain circumstances, more segments are installed than are necessary or fewer segments are installed than are necessary. Once the segments are installed in the earth, it is difficult to fully determine the number of segments that have been placed beneath the structure, i.e. pile depth.

In the past, various patents have issued relating to the installation of such pressed pile segments. U.S. Pat. No. 5,288,175, issued on Feb. 22, 1994, to D. W. Knight, describes a segmental precast concrete underpinning pile and method using a method of installation where a wire strand aligns the precast segments during installation, provides a means for measurement of pile penetration depth, and continuously reinforces the pile when bonded or anchored upon completion. The depth of pile penetration is inspected by reading the strand marker at the point of installation or may be calculated by measuring the length of the strand remaining from the tip marker and subtracting that length from the calibrated strand length. The depth of pile penetration is inspected when the pile reaches the point of completion. Unfortunately, this is not an entirely reliable technique for measuring pile penetration during the actual installation of the piles. The use of the actual strand as a marker can be a relatively expensive technique for measuring pile depth penetration. Often the laborers will cut the cable in order to finish capping and shimming. The cut portion of the cable is disposed of prior to the engineer's inspection thereby preventing the engineer from verifying actual pile depth. Since pile depth is often undocumented prior to cutting and disposing of the cable, the actual depth is unverifiable and a matter of opinion and disagreement.

U.S. Pat. No. 5,399,055, issued on Mar. 21, 1995 to E. T. Dutton, Jr., teaches a device and method for leveling and repairing a failed concrete foundation. In this patent, a series of cylindrical pile segments are jacked into the soil while water jetting to a predetermined depth. Reinforcing steel is inserted into the stacked column of cylindrical pile segments. Grount is pumped into the cylindrical pile segments to suitably fix the reinforced steel to the inside of the pile segments. This forms a single shaft pile and does not prevent deflection during installation.

U.S. Pat. No. 6,179,526, issued on Mar. 30, 2001 to Knight et al., teaches a method of forming a pile isolation void including the steps of forming a foundation pile having an enlarged cross-section within a specific localized section and driving the foundation pile a desired distance into the earth so as to form a pile isolation void directly above the enlarged cross-section. The enlarged cross-section can be located at the bottom of the foundation pile or along the length of the foundation pile. The pile isolation void is an annular void extending around the foundation pile above the enlarged cross-section.

U.S. Pat. No. 6,200,070, issued on Mar. 13, 2001 to D. W. Knight, teaches a process of installing piles for supporting a structure upon the earth. This process includes the steps of forming a receptacle in a first pile segment, affixing an end of a strand into the receptacle such that the strand extends outwardly from the first pile segment, sliding a second pile segment onto the strand until the second pile segment contacts a surface of the first pile segment, and driving the second pile segment a desired distance into the earth. The receptacle is formed in the first pile segment while the first pile segment is in the earth. The step of affixing an end of the strand includes the steps of introducing a structural adhesive into a hole formed in the first pile segment, introducing an end of the strand into the hole such that the adhesive contacts the strand and the pile segment, and solidifying the adhesive around the end of the strand such that the end of the strand is rigidly and non-removably secured within the hole in the pile segment.

It is an object of the present invention to provide a method of measuring differential movements between piles and a strand in order to measure deflection of the pile segments during installation.

It is another object of the present invention to provide a method of measuring a depth of a pile which can allow inspectors to determine the pile depth subsequent to installation.

It is a further object of the present invention to provide a method of measuring a depth of a pile which is easy to use, relatively inexpensive and easy to manufacture.

It is still a further object of the present invention to provide a method of measuring a depth n of a pile which is indicative of any misalignment that can occur subsequent to installation.

These and other objects and advantages of the present invention will become apparent from a reading of the attached specification and appended claims.

BRIEF SUMMARY OF THE INVENTION

The present invention is a method of measuring the depth of a pile which supports a structure on the earth comprising the steps of: (1) affixing a flexible strand to a first pile segment; (2) driving the first pile segment a desired distance into the earth such that the flexible strand extends along the length of the first pile segment along an exterior surface thereof; and (3) driving a second pile segment into the earth another desired distance such that the second pile segment resides on a top end of the first pile segment. The flexible strand extends along a length of the second pile segment on an exterior surface of the second pile segment.

Additionally, in the present invention, the method includes the step of driving a plurality of additional pile segments into the earth such that the plurality of additional pile segments reside on an end of the second pile segment opposite the first pile segment. The flexible strand extends along a length of the plurality of additional pile segments on an exterior surface thereof. The first and second pile segments and the plurality of pile segments forms the pile which supports the structure.

An end of the flexible strand is attached to the first pile segment adjacent the bottom end of the first pile segment. Alternatively, an annular member can be inserted into the interior of the first pile segment so as to support a ring member extending outwardly of the exterior surface of the first pile segment at the bottom of the first pile segment. The end of the flexible strand can then be attached to the ring member.

The flexible strand is marked with indicia corresponding to length measurements. More particularly, the flexible strand can correspond to the length of the individual pile segments. The flexible strand is formed of an inelastic material.

The method of the present invention can also include the step of monitoring a length of the flexible strand during the driving of the plurality of pile segments. The step of monitoring can include measuring the rate at which the plurality of pile segments are driven into the earth and then comparing the rate at which the plurality of pile segments are driven into the earth with the rate in which the flexible strand moves into the earth.

The present invention is also a pile length measurement apparatus comprising a plurality of pile segments stacked in end-to-end relationship in the earth, and a flexible strand affixed at one end to the lowermost pile segment. The flexible strand extends along an exterior surface of the plurality of pile segments in surface-to-surface contact with the plurality of pile segments. The flexible strand has indicia formed thereon indicative of length measurements. The flexible strand is formed of an inelastic material.

DETAILED DESCRIPTION OF THE INVENTION

Figure 1:
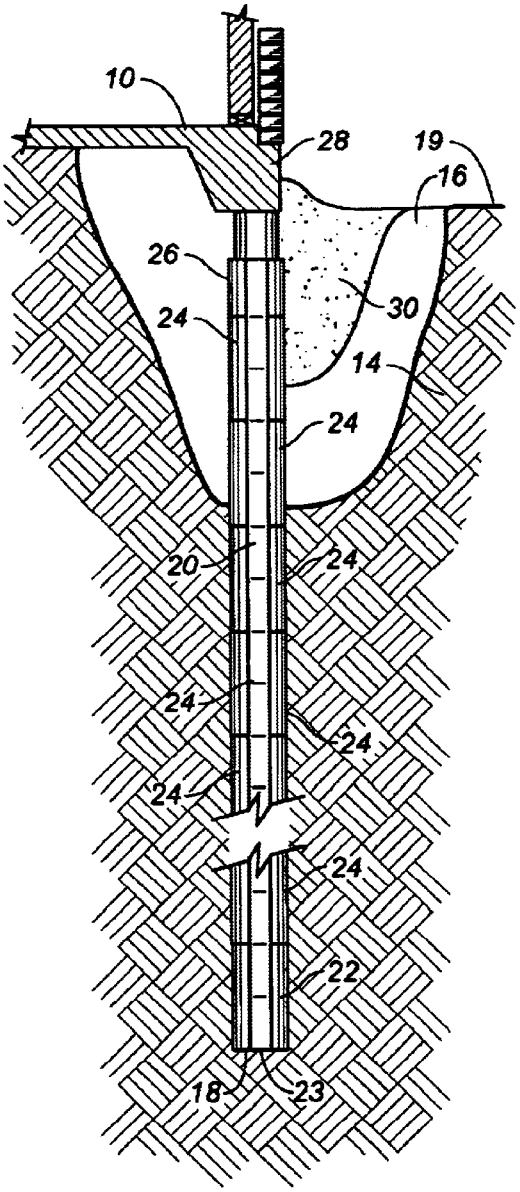
FIG. 1 is an illustration showing the completed method of the present invention for the supporting of a building structure.

Referring to FIG. 1, there is shown the completed process for the installation of piles for supporting a structure 10 upon the earth. In FIG. 1, it can be seen that a plurality of pile segments extend deeply into the earth 14. An excavation 16 is carried out below the surface 19 of the earth 14. This excavation 16 serves to expose the area below the foundation 28 of the building structure 10.

In FIG. 1, it can be seen that the plurality of pile segments 24 extend upwardly from the first pile segment 22 through the earth 14. A cap member 26 is positioned so as to be placed directly below the bottom of the building structure 10 to properly support the foundation 28 of the building structure 10 in a desired position. The excavation 16 can be filled in with a filler material 30 so as to close the excavation 16 and to enclose the pile segments 22 and 24, along with the cap member 26, within the earth 14.

In FIG. 1, it can be seen that a flexible strand 20 has a lowermost end 23 secured to the bottom 18 of the first pile segment 22. The flexible strand 20 is in the nature of packing tape with numerical indicia 25 printed at even intervals on the exterior surface of the flexible strand 20. The flexible strand 20 will extend along the exterior surface of the pile segments 24 and terminate at the end of the cap member 26 just below the foundation 28. As a result, the marker at the top end of the flexible strand 20 will indicate the depth of the pile structure below the foundation 28.

Figure 2:
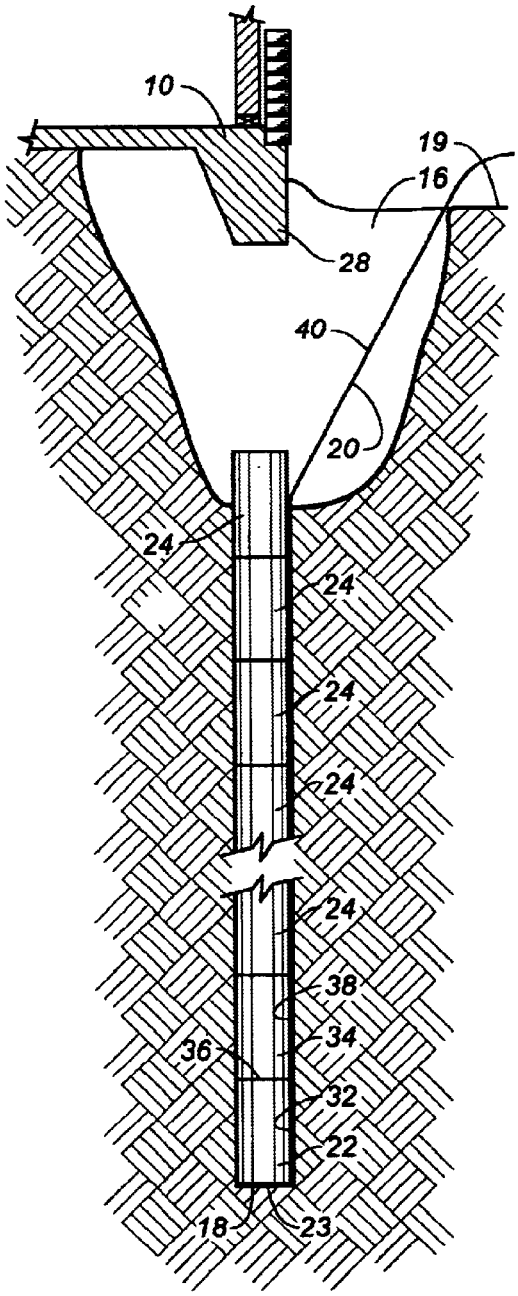
FIG. 2 shows an early stage in the installation of the pile structure in accordance with the teachings of the present invention.

The method of the present invention is particularly shown in FIG. 2. Initially, the flexible strand 20 has its lowermost end 23 affixed to the bottom 18 of the first pile segment 22. The first pile segment 22 is then driven into the earth a desired distance such that the flexible strand will extend along the exterior surface 32 of the first pile segment 22. A second pile segment 34 is then driven into the earth another desired distance such that the second pile segment 34 resides on the top end 36 of the first pile segment 22. As can be seen, the flexible strand 20 extends along the exterior surface 38 of the second pile segment 34. Similarly, a plurality of additional pile segments 24 are installed into the earth in a similar manner as the first pile segment 22 and the second pile segment 34. As can be seen, once again, the flexible strand 20 will extend along the exterior surface of these additional pile segments. Ultimately, the flexible strand 20 has a portion 40 which will be exposed in the excavation 16 and extend outwardly of the earth 19. Each of the pile segments are arranged so as to extend just below the foundation 28 of the structure 10.

The pile segments are often used in the repair of foundations for both residential and commercial buildings. The pile depth is a factor in the final stability of a pressed pile and, therefore, the ability to measure this depth is of benefit to the engineers and repair crew involved. Also, in deep piles, the pile may curve out of desired vertical alignment as it is being pressed and any differential in the rate of movement between the pile and the strand indicates that the pile has curved out of alignment. Through the natural technique of installation, the strand 20 will extend in surface-to-surface contact with the exterior surfaces of each of the pile segments. If the pile segments should move out of alignment during installation, it will be noticeable that there is a differential between the length of the strand and the length of the piles that have been installed into the earth. Subsequent to installation, the strand can remain loose in the earth. If it is necessary to later inspect to see the depth of pile penetration, the area beneath the foundation 28 can be excavated so as to expose the uppermost pile segment and to expose the flexible strand, along with the numerical indicia indicative of the pile depth.

Figure 3:
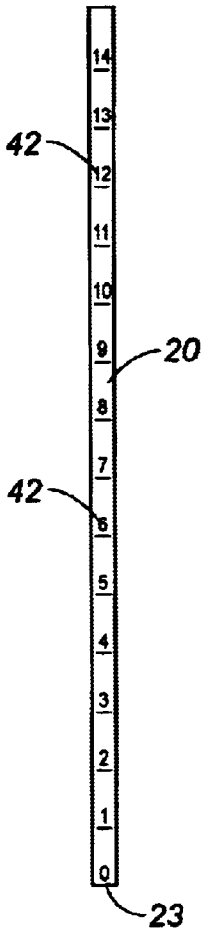
FIG. 3 is an isolated side elevational view of the flexible strand as used in the present invention.

FIG. 3 shows an isolated view of the strand 20. As can be seen, the strand 20 is a longitudinal member that has its lowermost end 23 suitable for affixing against the bottom 18 of the lowermost pile segment 22. The lowermost end 23 can have a suitable adhesive on an end thereof so that the end 32 can be adhered to the exterior surface of the lowermost pile segment. Alternatively, other techniques can be used so as to securely affix the end 23 of the strand 20 to the bottom of the lowermost pile segment. Numerical indicia 42 are arranged at even intervals along the length of the strand 20. The numerical indicia 42 are indicative of length measurement or indicative of pile length. For example, in FIG. 3, the numerical indicia would be indicative of the number of piles that have been installed in the earth. The flexible strand 20 can be in the nature of a packing tape which is generally inelastic. Strand 20 should be suitably flexible so as to reside in surface-to-surface contact with the exterior surface of the pile segments as they are installed in the earth. The strand 20 should be of a durable material that will not degrade after long contact with the in-earth environment.

Figure 4:
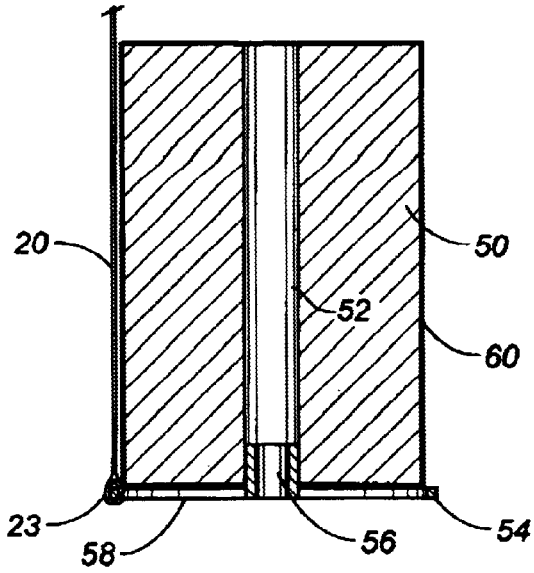
FIG. 4 is a cross-sectional view showing a manner of attaching the flexible strand to a first pile segment wherein the pile segment has an annular void.

FIG. 4 shows an isolated view of a single pile segment 50. Pile segment 50 will be the lowermost pile segment in a pressed pile structure. The lowermost pile segment 50 has an annular void 52 through which a strand or cable or reinforcing bar can be installed. When pile segments of the type shown in FIG. 4 are installed into the earth, then a special structure can be employed so as to allow the securing of the strand 20 to such a pile segment. In FIG. 4, it can be seen that en an installation member 54 is provided. This installation member 54 has an annular member 56 at a center thereof. Annular member 56 is suitable for insertion into the annular void 52 of the pile segment 50. A ring member 58 is connected to the annular member 56 so as to extend outwardly beyond the exterior surface 60 of the pile segment 50. The strand 20 has its lowermost end 23 secured around the ring member 58 so as to extend upwardly adjacent to the exterior surface 60 of the pile segment 50.

Figure 5:
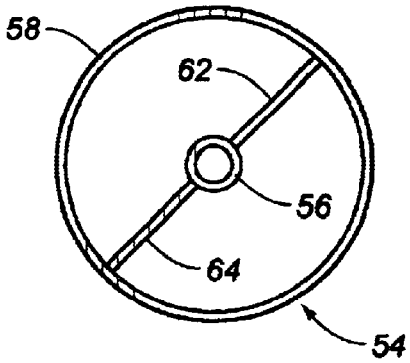
FIG. 5 is a bottom view showing the device for attaching the strand of FIG. 4.

FIG. 5 is a bottom view showing the configuration of the installation member 54. In FIG. 5, it can be seen that the annular portion 56 is centered within the ring member 58. Struts 62 and 64 will extend from the annular member 56 to the ring member 58. The strand 20 can be secured anywhere around the ring member 58 so as to extend upwardly along the exterior surface 60 of the pile segment 50 toward the surface.

Figure 6:
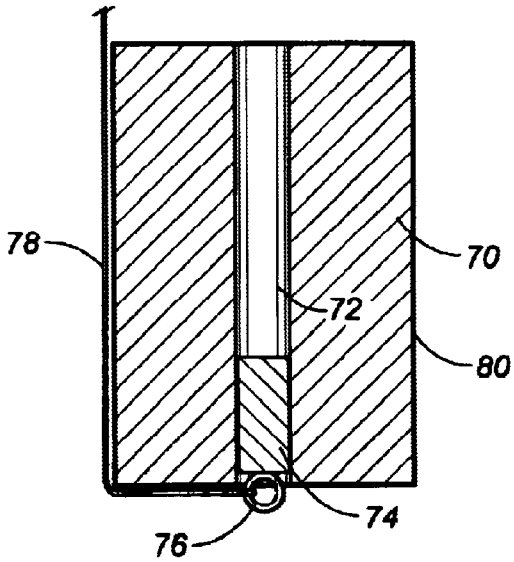
FIG. 6 is a cross-sectional view of an alternative embodiment of the present invention.

FIG. 6 shows an alternative embodiment of the present invention as used in association with a single pile segment 70. Pile segment 70 will be the lowermost pile segment in a pressed pile structure. The lowermost pile segment 70 has an annular void 72 into which a rigid rod 74 is inserted. The rod 74 extends into the annular void 72 for a suitable distance. A ring 76 is affixed to the bottom of the rigid rod 74. A flexible strand 78 has its lowermost end connected to the ring 76. The strand 78 will extend across a portion of the bottom of the pile segment 70 and then upwardly along the exterior surface 80 of the pile segment 70.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A method of measuring a length of a pile which supports a structure upon the earth comprising:

affixing a flexible strand to a first pile segment;

driving said first pile segment a desired distance into the earth such that said flexible strand extends along a length of said first pile segment along an exterior surface of said first pile segment;

driving a second pile segment into the earth another desired distance such that said second pile segment resides on a top end of said first pile segment, said flexible strand extending along a length of said second pile segment on an exterior surface of said second pile segment;

driving a plurality of additional pile segments into the earth such that said plurality of additional pile segments reside upon an end of said second pile segment opposite said first pile segment, said flexible strand extending along a length of said plurality of additional pile segments on an exterior surface of said plurality of additional pile segments; and monitoring a length of said flexible strand during said step of driving said plurality of pile segments, said step of monitoring comprising;

monitoring a rate at which said plurality of pile segments are driven into the earth; and comparing the rate at which said plurality of pile segments are driven into the earth with a rate at which said flexible strand moves into the earth.

2. The method of claim 1, said first pile segment and said second pile segment and said plurality of additional pile segments forming dee pile which supports the structure.

3. The method of claim 2, further comprising:

cutting said flexible strand at a top of said plurality of additional pile segments opposite said second pile segment and just below the structure.

4. The method of claim 1, further comprising:

marking said flexible strand with indicia corresponding to length measurements.

5. The method of claim 1, said step of affixing said flexible strand comprising:

adhering an end of said flexible strand to the exterior surface of said first pile segment adjacent a bottom end of said first pile segment.

6. The method of claim 1, said step of affixing said flexible strand comprising:

inserting an annular, member into an interior of said first pile segment, said annular member supporting a ring member extending outwardly of the exterior surface of said first pile segment at a bottom end of said first pile segment; and attaching an end of said flexible strand to said ring member.

7. The method of claim 1, said flexible strand being of an inelastic material.

8. The method of claim 1, said step of affixing said flexible strand comprising:

inserting a rigid rod into an interior of said first pile segment, said rigid rod having a ring at an end thereof at a bottom of said first pile segment; and attaching an end of said flexible strand to said ring such that said flexible strand extends across said bottom of said first pile segment and upwardly along said exterior surface of said first pile segment.

9. A method of measuring a length of a pile which supports a structure upon the earth comprising:

marking a flexible strand with indicia corresponding to length measurements;

affixing said flexible strand to a first pile segment;

driving said first pile segment a desired distance into the earth such that said flexible strand extends along the length of said first pile segment on an exterior surface of said first pile segment;

driving a plurality of additional pile segments into the earth such that said plurality of additional pile segments reside upon an end of said first pile segment, said flexible strand extending along a length of said plurality of additional pile segments on an exterior surface of said plurality of additional pile segments; and monitoring a length of said flexible strand during said step of driving said plurality of pile segments, said step of monitoring comprising:

monitoring a rate at which said plurality of pile segments are driven into the earth; and comparing the rate at which said plurality of pile segments are driven into the earth with a rate at which said flexible strand moves into the earth.

10. The method of claim 9, said flexible strand being of an inelastic material.

* * * * *